US006267238B1

(12) United States Patent
Miller et al.

(10) Patent No.: US 6,267,238 B1
(45) Date of Patent: Jul. 31, 2001

(54) CASE FOR POWER TOOL HAVING ATTACHED POWER CORD

(75) Inventors: Paul Joseph Miller, Hoffmann Estates; Robert J. Knutsen, Hickory Hills, both of IL (US)

(73) Assignee: Hand Tools International, LLC, Lake Zurich, IL (US)

( * ) Notice: Subject to any disclaimer, the term of this patent is extended or adjusted under 35 U.S.C. 154(b) by 0 days.

(21) Appl. No.: 09/475,423

(22) Filed: Dec. 30, 1999

(51) Int. Cl.[7] ..... A45C 11/26
(52) U.S. Cl. ..... 206/349; 206/372; 206/702
(58) Field of Search ..... 206/234, 349, 206/372, 373, 576, 702

(56) References Cited

U.S. PATENT DOCUMENTS

| | | | | |
|---|---|---|---|---|
| 1,608,325 | | 11/1926 | Lang . | |
| 2,439,004 | | 4/1948 | Hurley . | |
| 2,667,966 | | 2/1954 | Jepson et al. . | |
| 2,825,767 | | 3/1958 | Riedele . | |
| 3,136,408 | | 6/1964 | Rockmann . | |
| 3,317,076 | | 5/1967 | Enders . | |
| 3,327,841 | * | 6/1967 | Schurman et al. . | |
| 3,347,359 | | 10/1967 | Kolesh et al. . | |
| 4,037,720 | | 7/1977 | McGurk . | |
| 4,380,293 | | 4/1983 | Wilcox et al. . | |
| 4,718,085 | | 1/1988 | Haskins . | |
| 4,723,657 | | 2/1988 | Robinson . | |
| 4,917,239 | * | 4/1990 | Smith . | |
| 4,927,021 | * | 5/1990 | Taylor | 206/373 |
| 5,533,843 | * | 7/1996 | Chung | 408/241 R |
| 5,772,036 | * | 6/1998 | Muncy et al. | 206/702 |
| 5,884,008 | * | 3/1999 | Goldberg | 392/385 |

* cited by examiner

*Primary Examiner*—David T. Fidei
(74) *Attorney, Agent, or Firm*—Fitch, Even, Tabin & Flannery

(57) ABSTRACT

A case for a power tool is provided that has a pathway about the periphery thereof in which a power cord for the tool can be held. Preferably, the body of the tool is held in a cavity in the case and the power cord pathway extends around the cavity. The pathway can be of a depth sufficient to allow the cord to be wrapped over itself therein so that long power cords can be held in the pathway of the case. The power cord is held in the case by an interference or press fit therein so that it securely stays in place during transport of the case. Accordingly, the present case provides a well-defined location in which a power cord for a tool can be placed vis-a-vis peripheral pathway thereof in an efficient, space-saving manner.

7 Claims, 6 Drawing Sheets

CASE FOR POWER TOOL HAVING ATTACHED POWER CORD

FIELD OF THE INVENTION

The invention relates to carrying case and, more particularly, to a case for carrying a power tool having an attached power cord.

BACKGROUND OF THE INVENTION

Cases for power tools generally focus on holding the tool in some exact location in the case so that it does not get banged about therein when it is carried from location to location. However, one of the big problems is where the power tool has an attached so-called "pigtail" power cord. In this instance, the cord is usually just wrapped by the users so that it fits in the case in the most convenient location they can find. This is often times not a satisfactory solution as the cord can become unwrapped and very sloppy to work with. To this end, there are cases that provide for separate compartments therein for power cords. However, depending on the length of the cord, such compartments may not be feasible as they would have to be too large in comparison to the remaining size of the case to hold the cord therein.

Accordingly, there is need for a case for a power tool that holds the power cord therefor in an improved manner. More particularly, a case is needed for power tools that have long power cords where the case efficiently and securely holds the long cord therein.

SUMMARY OF THE INVENTION

In accordance with the present invention, a case for a power tool is provided that has a pathway about the periphery thereof in which a power cord for the tool can be held. Preferrably, the body of the tool is held in a cavity in the case and the power cord pathway extends around the cavity. The pathway can be of a depth sufficient to allow the cord to be wrapped over itself therein so that long power cords can be held in the pathway of the case. The power cord is held in the case by an interference or press fit therein so that it securely stays in place during transport of the case. Accordingly, the present case provides a well-defined location in which a power cord for a tool can be placed vis-a-vis peripheral pathway thereof in an efficient, space-saving manner.

In one form of the invention, a case is provided for carrying a power tool having a power cord attached to one end thereof. The case includes a lower portion for receiving the power tool in a predetermined position therein. A cavity is provided in the lower portion generally matching the shape of the power tool to locate the tool in the predetermined position. An outer perimeter extends about the case lower portion and defines a pathway in which the power cord is held. An upper portion of the case is provided for being closed onto the case lower portion to carry the tool in the predetermined position in the case with the cord extending about the tool in the outer perimeter pathway.

In a preferred form, the pathway includes a plurality of pairs of opposing projections disposed along the pathway with the opposing projections having a predetermined spacing sized to receive the power cord therebetween by a press fit to securely maintain the power cord in the pathway.

In one form, the pathway includes sidewalls having a height that provide sufficient depth to the pathway to allow the cord to be overlapped on top of itself therein.

The case upper portion can include a well adjacent with the pathway for receiving a plug head on the power cord therein.

In a preferred form, the case lower portion includes a plurality of racks extending between the pathway and tool cavity and forming wells therebetween. The racks each include a plurality of slots sized to hold shafts of bits for the tool therein with heads of the tool bits disposed in adjacent wells.

In one form, the case upper and lower portions are of molded plastic and are integral with each other, the case portions being hingedly connected via a living hinge therebetween.

In one form, the case upper portion includes a flexible internal panel. The panel includes a depression substantially matching the shape of the power tool so that when case upper portion is closed on the case lower portion the depression will engage on one side of the tool and push the other side thereof tightly into the cavity to securely maintain the tool in the predetermined position in the case during transport thereof.

In a preferred form, the case portions each include a cut-out so that when the case is closed a user can extend their hand through the cut-out The cut-out forms an outer handle portion by which the user can carry the case and through which the pathway extends.

DETAILED DESCRIPTION OF THE PREFERRED EMBODIMENT

Figure 1:
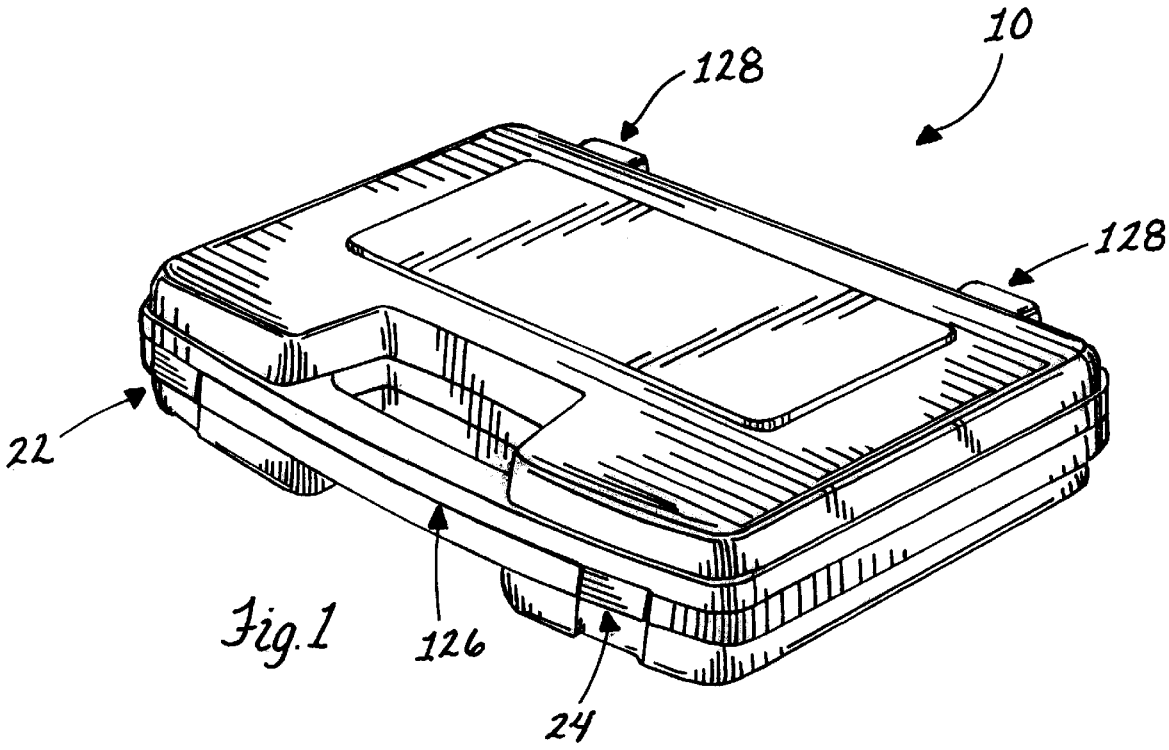
FIG. 1 is a perspective view of a case for carrying a power tool in accordance with the present invention showing upper and lower portions thereof closed together.

In FIGS. 1–5, a case 10 for carrying a power tool 12 having an attached power cord 14 in accordance with the present invention is shown. The case 10 has an upper half portion 16 and a lower half portion 18 which are preferably molded plastic parts. In this regard, the case portions 16 and 18 can be integral and connected via a thin flexible hinge piece 20 of plastic material extending therebetween to form a living hinge so that the case 10 can be pivoted between its closed condition of FIGS. 1 and 2 to its open condition of FIGS. 3–5. Latches 22 and 24 are provided to keep the case portions 16 and 18 in their closed condition during transport of the case 10 from location to location.

The case lower portion 18 has a well-defined pathway 26 for receipt of a power cord 14 therein. In this regard, the present case 10 does not use a separate compartment in the case 10 for storage of the power cord 14 but instead forms the pathway 26 about perimeter 28 of the case lower portion 18 for efficient utilization of space therein while also allowing for long power cords to be received therein, as more fully discussed hereinafter.

More particularly, the case 10 can have a generally rectangular shape so that the case upper portion 16 has sides 30 and 32 interconnected by ends 34 and 36, and the case lower portion 18 includes corresponding sides 38 and 40 interconnected by ends 42 and 44. The power cord pathway 26 extends adjacent to the case lower portion sides and ends 3844 so as to keep the cord 14 at the outer perimeter 28 of the case portion 18 which provides more space for significant other case details in the case lower portion 18 as described herein.

The case lower portion 18 has a cavity, generally designated 46, that generally matches the shape of the power tool so that it can be located in a consistent, predetermined position in the case 10. The illustrated and preferred tool 12 is a detailing tool having a slightly bent configuration with a larger diameter rear gripping portion 48 offset angularly from a smaller diameter forward portion 50. The power cord 14 is attached to the end of the tool gripping portion 48 and extends therefrom, as can be seen in FIG. 5. Accordingly, the shape of the illustrated cavity 46 accommodates this shape of power tool 12 as the cavity 46 includes an enlarged portion 52 which steps up to smaller cavity portion 54 via shoulder wall 56 therebetween. At the leftmost end of the cavity small portion 54 as viewed in FIG. 4, a larger area 58 of the cavity portion 54 is provided for receipt of the tool collect 60 at the forward end of the tool portion 50. The cavity portion 52 terminates generally opposite shoulder wall 56 at end wall 62 adjacent the portion of the pathway 26 extending along the end 44 of the case lower portion 18. In this manner, with the tool 12 received in the cavity 46 as shown in FIG. 5, the cord can start to be fitted in the pathway 26 along the case lower portion end 44.

Figure 4:
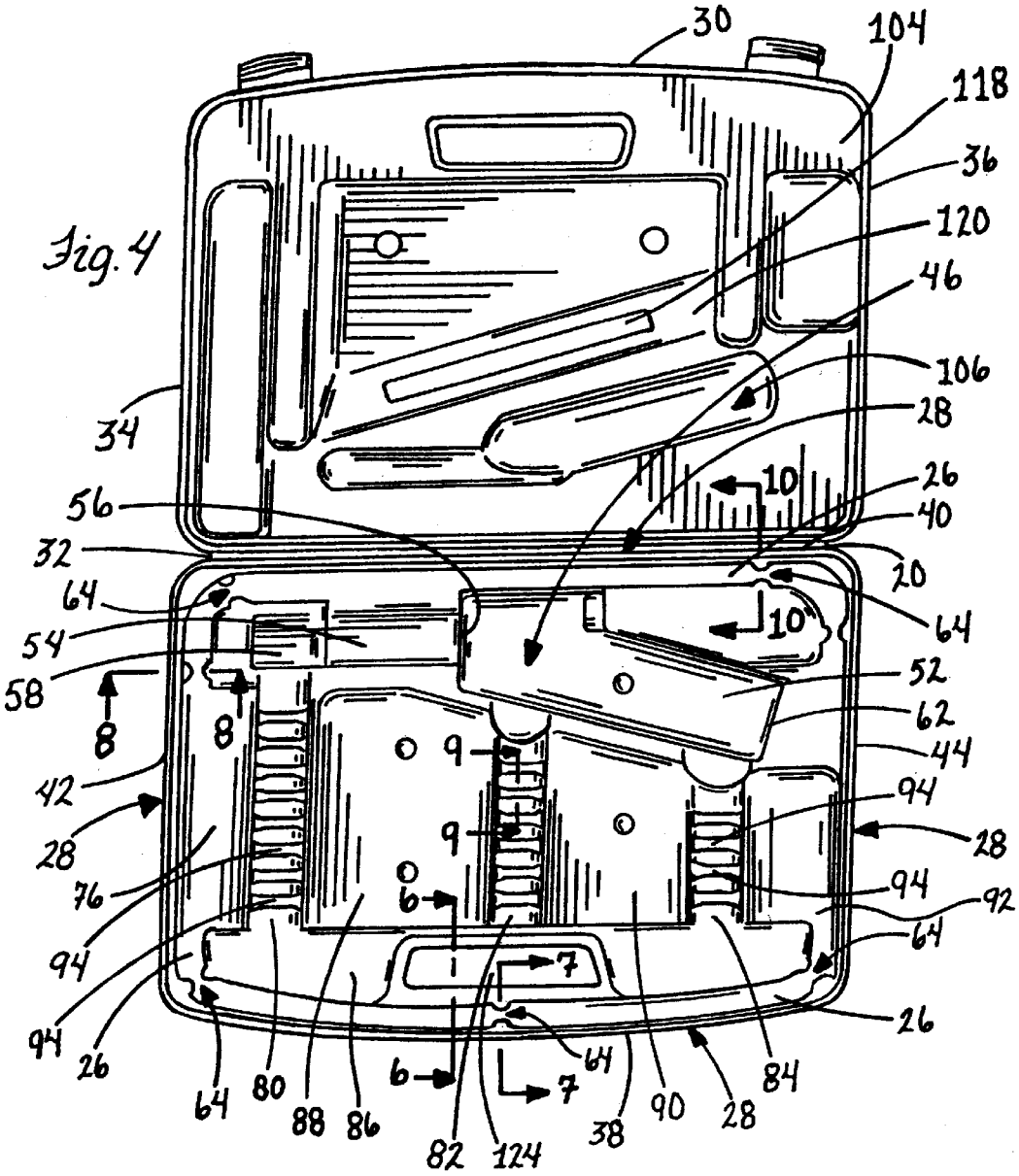
FIG. 4 is a plan view of the open case of FIG. 3.
Figure 6:
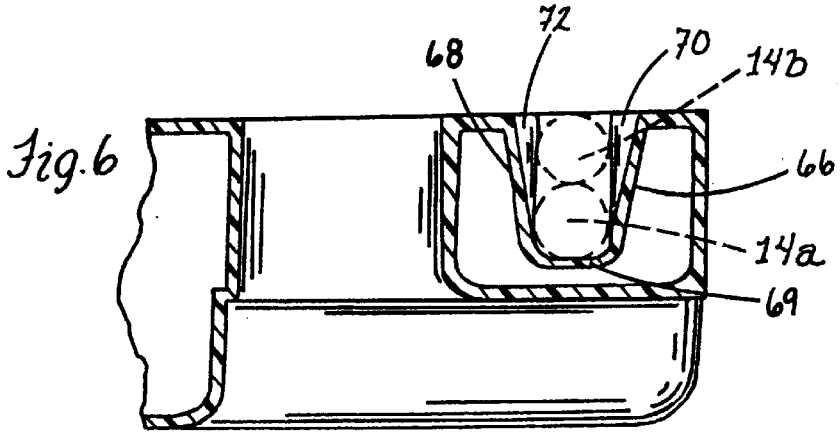
FIG. 6 is a cross-sectional view taken along line 6—6 of FIG. 4 showing a power cord in ghost received in overlapping fashion onto itself in the pathway and press fit against opposing projections therein.
Figure 5:
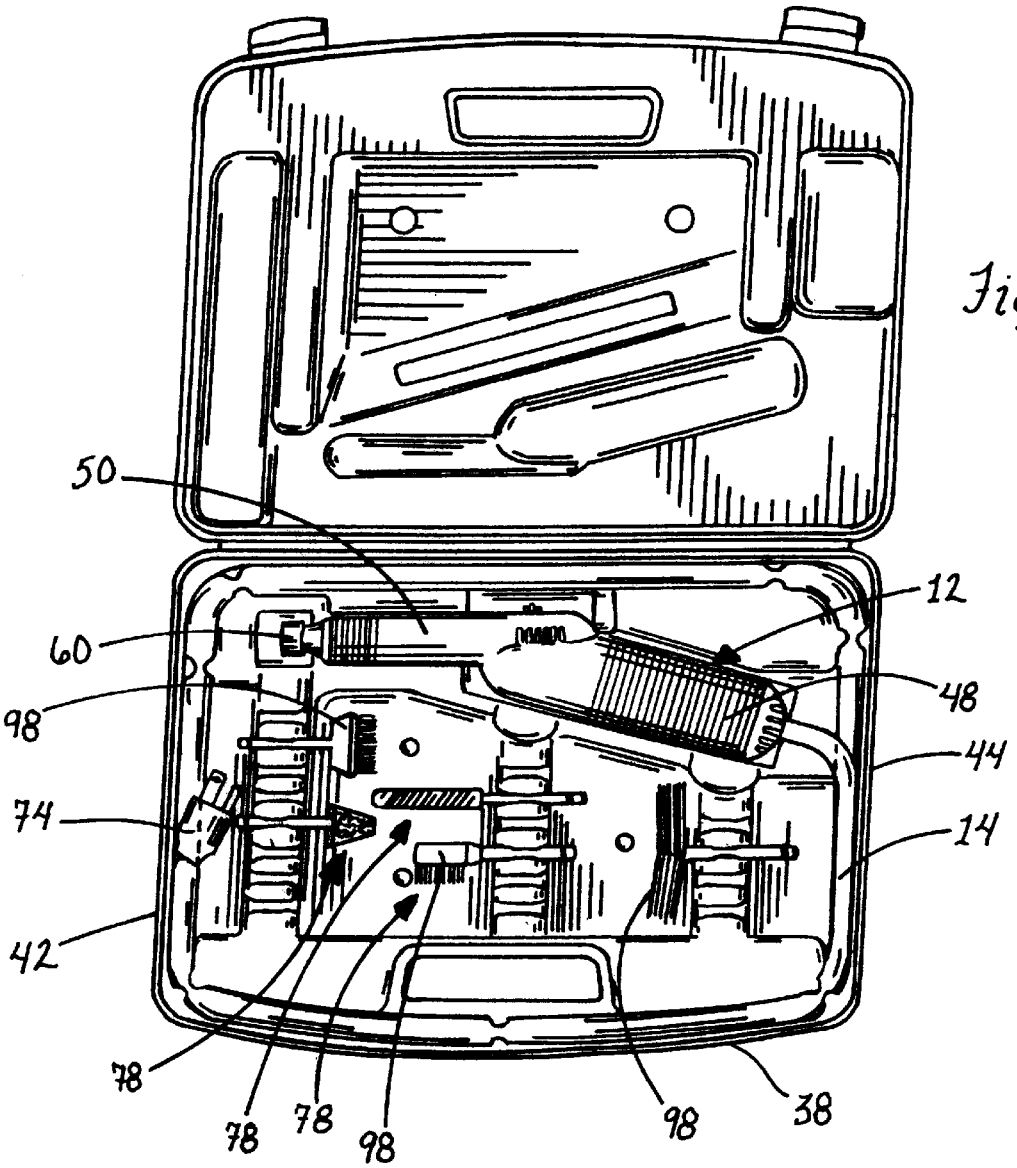
FIG. 5 is a view similar to FIG. 4 showing the tool, its power cord and various bits therefor positioned in the case lower portion.
Figure 7:
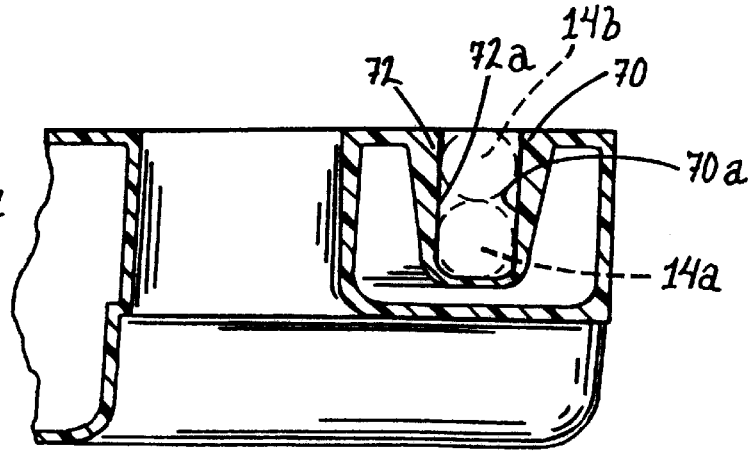
FIG. 7 is a cross-sectional view taken along line 7—7 of FIG. 4 showing the overlapped power cord in ghost press fit against the opposing projections.
Figure 8:
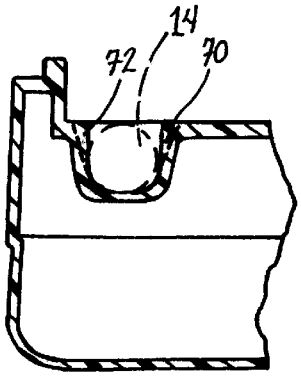
FIG. 8 is a cross-sectional view taken along line 8—8 of FIG. 4 showing a single length of power cord press fit in the pathway between shorter opposing projections.

To maintain the power cord 14 securely held in the pathway 26, a plurality of pairs of opposing nub projections, generally designated 64, are provided at various locations about the pathway 26, as can be seen in FIG. 4. The spacing between these projections 64 is sized for press fitting the cord 14 therebetween so that the cord 14 will not shift out from the pathway 26 during transport. More specifically, the pathway 26 is formed by slightly inclined outer and inner side walls, 66 and 68, respectively. These walls 66 and 68 are connected at their lower ends by bottom wall 70 so that the distance from the top of the side walls 66, 68 to the bottom wall 70 defines the depth of the pathway 26. The opposing projections 64 preferably extend the full height of the walls 66 and 68 and include an outer projection 70 extending inwardly into the pathway 26 from the outer side wall 66 and an inner projection 72 extending into the pathway 26 from the inner side wall 68, as can be seen in FIGS. 6 and 7. The outer and inner projections 70 and 72 have substantially vertical surfaces 70*a* and 72*a* at their innermost ends. Accordingly, while the power cord 14 generally loosely fits in the pathway 26, at the locations of the opposing pairs of projections 64, the cord 14 will be tightly gripped by the respective outer and inner projections 70 and 72, and specifically surfaces 70*a* and 72*a* thereof for securely maintaining the cord 14 in the pathway 26.

Where the power cord 14 has a long length such as a length that is greater than the combined lengths of the case lower portion sides and ends 38–44, the present pathway 26 is provided with sufficient depth in terms of the height of its side walls 66 and 68 to allow the power cord 14 to be wrapped over onto itself, as shown in FIGS. 5–7. In other words, the pathway 26 is of sufficient depth so that a first length of power cord 14a can be inserted therein while still leaving room thereabove for a second length 14b of the same power cord 14 to be inserted in the pathway 26 thereover. With the illustrated tool 12 and power cord 14, the overlap begins at the point of entry of the power cord into the pathway 26 along end 44 of the case lower portion 18 and continues along the pathway 26 adjacent the case portion side 38 and for a small section of the pathway 26 adjacent case portion end 42. Along this portion of the perimeter 28 of the case portion 18, the walls 66 and 68 and projection pairs 64 there along are of the greater height, as illustrated in FIGS. 6 and 7. On the other hand, as shown in FIG. 8, where only a first length of the power cord 14 is received in the pathway 26 such as at projection pairs 64 adjacent the corner junction between case lower portion side 40 and end 42, the side walls 66 and 68 and projection pairs 64 thereat can have a shorter height At the end of the power cord 14, there is an enlarged plug head 74 for making electrical connection with a power source for operation of the tool 12. As shown in FIG. 4, the pathway 26 opens up to a well 76 along case portion end 42. The well 76 is sized to receive the enlarged plug head 74 therein. Thus, with the illustrated cord 14 fully wrapped in the pathway 26 as shown in FIG. 5, the enlarged plug head 74 can be disposed in the well 76.

The present case 10 also allows tool bits, generally designated 78, for the power tool 12 to be held therein. To this end, three raised rack members 80,82 and 84 are provided in the case lower portion 18. These rack members 80–84 generally extend between the power cord pathway 26 along case portion side 38 and the power tool cavity 46.

More particularly, the rack member 80 has a long length and extends between a raised portion 86 of the case lower portion 18 extending along side 38 thereof and larger area 58 of cavity portion 54. The rack member 80 has a longer length than the next adjacent rack member 82 as rack member 82 extends between the raised portion 86 and the enlarged cavity portion 52 which angles toward the raised portion 86. Between the racks 80 and 82 is a well 88 with well 76 formed between the rack 80 and the end 42 of case lower portion 18. The shortest rack is rack 84 which extends between the raised portion 86 and the end of the enlarged cavity portion 52 adjacent end wall 62 thereof. Between racks 82 and 84 is a well 90, and between the rack 84 and end 44 of case lower portion 18 is a well 92.

Each of the racks 80–84 includes slots 94 formed therein. The slots 94 are each sized identically to receive identically sized shafts 96 of the tool bits 78 snugly therein. With the illustrated tool 12, and in particular the collect 60 thereof, it is designed to hold a square tool bit shaft 96 with the slots 94 configured accordingly, as best seen in FIG. 9. As can be seen in FIG. 5, with the shafts 96 received in the slots 94, the disparate heads 98 of the bits 78 can be disposed in the wells 88–92 as is convenient so that the differently configured heads 98 do not interfere with each other with the rear end of the shaft 96 extending into the adjacent one of the wells 88–92.

Figure 9A:
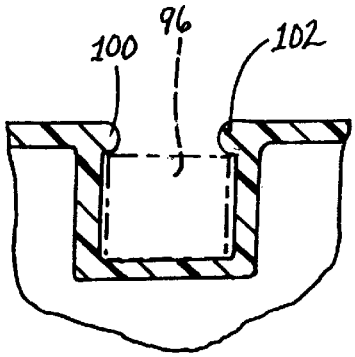
FIG. 9A is an enlarged view of one of the slots and one of the shafts in ghost received therein.
Figure 9:
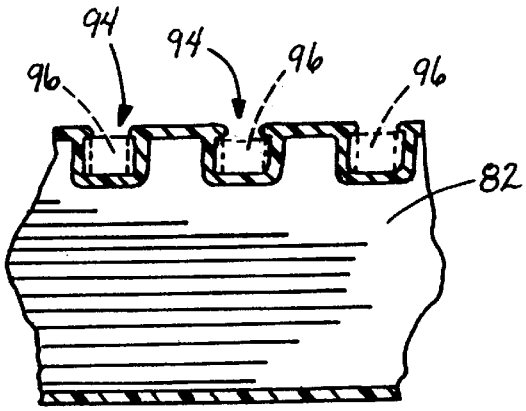
FIG. 9 is a cross-sectional view taken along line 9—9 of FIG. 4 showing a plurality of slots for receipt of tool bit shafts therein.
Figure 11:
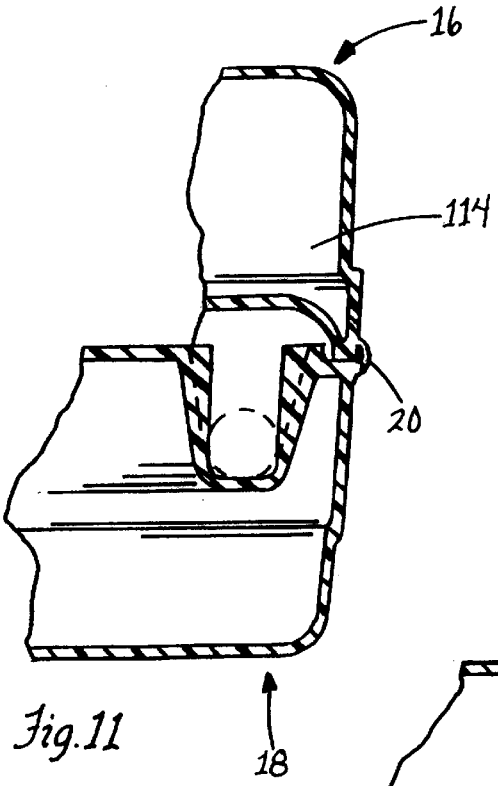
FIG. 11 is a cross-sectional view similar to FIG. 10 showing the case upper portion pivoted closed onto the case lower portion.
Figure 10:
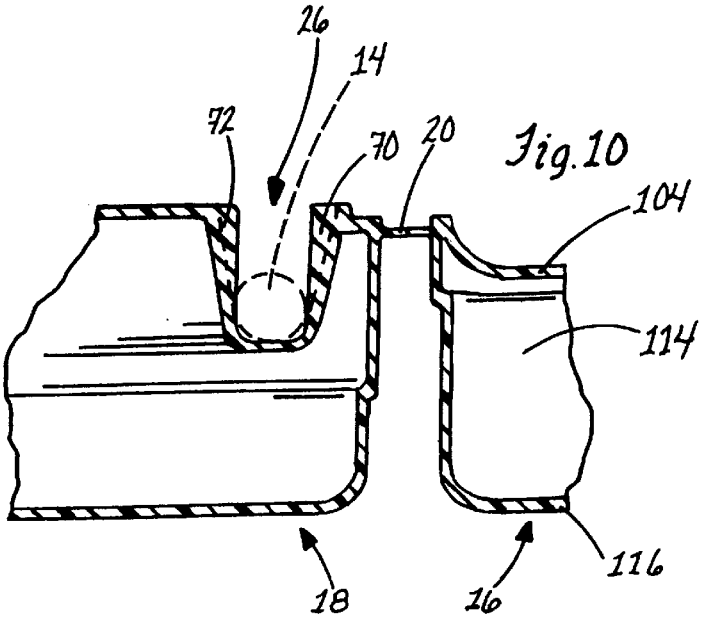
FIG. 10 is a cross-sectional view taken along line 10—10 of FIG. 4 showing a single length of cord press fit between opposing projections of the pathway.

Referring to FIG. 9A, the tool bit shafts 96 are securely held in the slots 94 via upper opposed projections 100 and 102. The spacing between the projections 100 and 102 is smaller than the length of a side of the square tool bit shaft 96 such that the shaft 96 must be press fit through the projections 100 and 102 to be received in the associated slot 94. Thereafter, the shaft 96 is restricted from falling out of the slot 94 by the projections 100 and 102 extending thereover.

The case upper portion 16 preferably has a flexible internal panel 104 having a depression 106 formed to the shape of the power tool 12 which cooperates to hold the tool 12 securely in the cavity 46 when the case upper portion 16 is closed onto the lower portion 18 via latches 22 and 24. In this regard, when the upper case portion 16 is pivoted via the living hinge 20 to is bring the depression 106 into engagement with the exposed side of the power tool 12 projecting out from the cavity 46, the case portions 16 and 18 will not be in position to be latched together. In other words, each of the latches 22 and 24 includes a latch member 108 on the case upper portion 16 with each latch member 108 having a hook portion 110 at the bottom thereof. The case lower portion 18 includes corresponding catch members 112 about which the hook portions 110 can be snapped. However, with the case upper portion 16 pivoted so that the depression 106 engages the tool 12, the hook portions 110 will not be able to be properly engaged with the catch members 112. To bring the hook portions 110 into position so that they can be snapped onto the catch members 112, the panel 104 is flexible in that it has some give so that the case upper portion 16 can be pivoted further toward the case lower portion 18 to allow the hook portions 110 to be in position to be snapped onto the catch members 112 for locking the case in the closed condition. To facilitate the resilient give of the panel 104, there is an air gap 114 provided between the panel 104 and external cover 116 of the case upper portion 16 and a cut-out opening 118 can be provided in an inclined wall 120 of the panel 104 adjacent the depression 106. In this manner, when the case 10 is in its closed condition, the depression surface 106 will resiliently engage the exposed side of the tool 12 and push it firmly into the cavity 46 to securely hold it in place during transport from one location to the next Each of the case upper and lower portions 16 and 18 is provided with an opening 122 and 124, respectively, adjacent respective sides 30 and 38 thereof. Accordingly, when the case 10 is latched closed via latches 22 and 24, an outer handle portion 126 of the case 10 will be defined, as best seen in FIG. 1. The openings 122 and 124 cooperate to allow a user to extend their hand therethrough while gripping the outer handle 126. Further, the space in the outer handle 126 is not wasted, as the power cord pathway 26 extends therethrough in the case lower portion 18.

Figure 2:
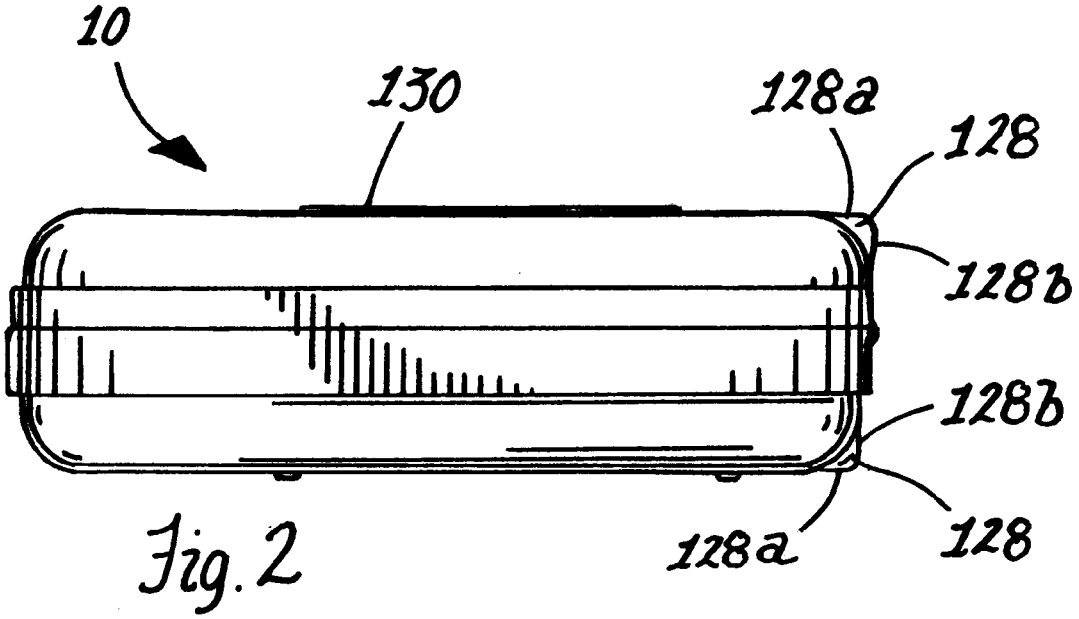
FIG. 2 is a side elevational view of the closed case of FIG. 1 showing stabilizing members at the rear of the case.
Figure 3:
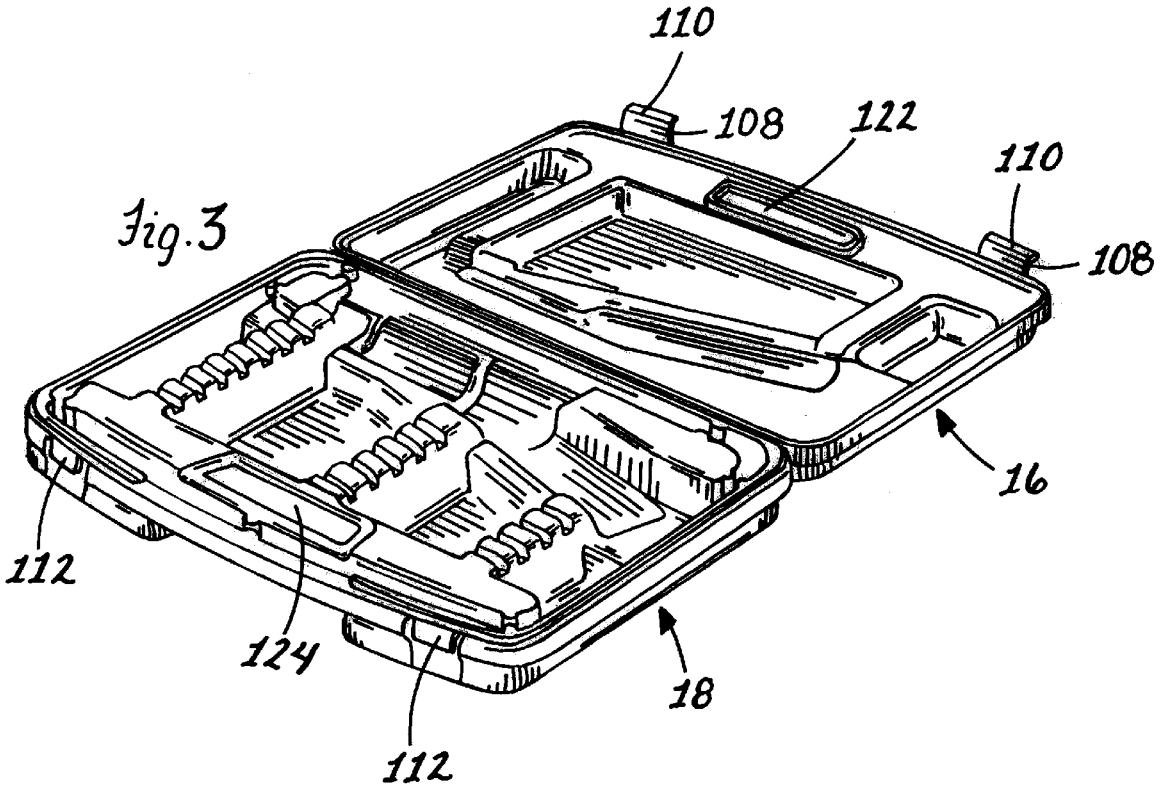
FIG. 3 is a perspective view of the case in an opened condition showing a cavity for the tool, a pathway for the tool power cord, and a plurality of racks for the tool bits in the case lower portion, and a panel of the case upper portion including a depression for engaging the tool when the case is closed.

As shown in FIG. 2, the case 10 generally has a rounded profile at the corners thereof. To enhance the stability of the case 10 when placed on a support surface vis-a-vis upper or lower portion 16 or 18 thereof, stabilizing members 128 are provided at the rear of the case 10. More specifically, the stabilizing members 128 are provided in laterally spaced pairs on each case portion 16 and 18 with the stabilizing members 128 of the upper case portion formed adjacent side 32 thereof and the stabilizing members 128 of case lower portion 18 formed adjacent side 40 thereof. Accordingly, the stabilizing members 128 are at the side of the case 10 closest to the heaviest component carried in the case 10, i.e. the power tool 12 itself. The stabilizing members 128 include flats 128*a* that are substantially planar with external cover 116 of the case upper portion 16 and external cover 130 so as to extend the flat area of engagement between the case 10 and the support surface over what normally would be provided. Further, flats 128*b* substantially perpendicular to flats 128*a* are provided. These flats 128*b* are not disposed beyond the rearward most points of the case portions 16 or 18 so that they do not interfere with pivoting of the case 10 to its opened condition, as shown in FIGS. 3–5.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

I claim:

1. A case for carrying a power tool having a power cord attached to one end thereof, the case comprising:

a lower portion of the case for receiving the power tool in a predetermined position therein;

a cavity in the lower portion generally matching the shape of the power tool to locate the tool in the predetermined position;

outer and inner sidewalls of the case lower portion that form an outer perimeter that extends about the case lower portion and which defines a pathway in which the power cord is held, the sidewalls having a predetermined varying height for receiving the power cord therebetween and in overlapping configuration along higher height locations of the sidewalls and in non-overlapping configuration along shorter height locations of the sidewalls; and an upper portion of the case for being closed onto the case lower portion to carry the tool in the predetermined position in the case with the cord extending about the tool in the outer perimeter pathway.

2. A case for carrying a power tool having a power cord attached to one end thereof, the case comprising:

a lower portion of the case for receiving the power tool in a predetermined position therein;

a cavity in the lower portion generally matching the shape of the power tool to locate the tool in the predetermined position;

an outer perimeter that extends about the case lower portion and which defines a pathway in which the power cord is held; and an upper portion of the case for being closed onto the case lower portion to carry the tool in the predetermined position in the case with the cord extending about the tool in the outer perimeter pathway, wherein the pathway includes a plurality of pairs of opposing projections disposed along the pathway with the opposing projections having a predetermined spacing sized to receive the power cord therebetween by a press fit to securely maintain the power cord in the pathway.

3. The case of claim 1 wherein the case upper portion includes a well adjacent with the pathway for receiving a plug head on the power cord therein.

4. The case of claim 1 wherein the case lower portion includes a plurality of racks extending between the pathway and tool cavity and forming wells therebetween, the racks each including a plurality of slots sized to hold shafts of bits for the tool therein with heads of the tool bits disposed in adjacent wells.

5. The case of claim 1 wherein the case upper and lower portions are of molded plastic and are integral with each other, the case portions being hingedly connected via a living hinge therebetween.

6. The case of claim 1 wherein the case upper portion includes a flexible internal panel section, the panel section including a depression substantially matching the shape of the power tool so that when case upper portion is closed on the case lower portion the depression will engage on one side of the tool and push the other side thereof tightly into the cavity to securely maintain the tool in the predetermined position in the case during transport thereof.

7. The case of claim 1 wherein the upper and lower case portions each include an opening so that when the case is closed a user can extend their hand through the opening, the opening forming an outer handle portion by which the user can carry the case and through which the pathway extends.

* * * * *